United States Patent [19]

Uchiyama et al.

[11] Patent Number: 4,595,191

[45] Date of Patent: Jun. 17, 1986

[54] PAPER FEED DEVICE HAVING RETRACTABLE SEPARATING PAWLS

[75] Inventors: Tadamitsu Uchiyama, Yokohama; Toshihiro Hayashi, Mitaka; Yoshinori Osamura, Machida, all of Japan

[73] Assignee: Minolta Camera Kabushiki Kaisha, Osaka, Japan

[21] Appl. No.: 660,318

[22] Filed: Oct. 12, 1984

[30] Foreign Application Priority Data

Oct. 17, 1983 [JP] Japan ..... 58-194595

[51] Int. Cl.[4] ..... B65H 3/56

[52] U.S. Cl. ..... 271/170; 271/901

[58] Field of Search ..... 271/20, 21, 170, 22, 271/171, 901

[56] References Cited

U.S. PATENT DOCUMENTS

| | | | |
|---|---|---|---|
| 3,285,601 | 11/1966 | Zeuthen | 271/17 |
| 3,417,988 | 12/1968 | Springer | 271/19 |
| 3,655,182 | 4/1972 | Rilinger | 271/170 |
| 3,689,064 | 9/1972 | Kuksa | 271/164 |
| 3,799,538 | 3/1974 | Suzuki | 271/170 X |
| 4,032,137 | 6/1977 | Katayama et al. | 271/170 X |
| 4,131,274 | 12/1978 | Sue | 271/170 X |
| 4,303,235 | 12/1981 | Calabrese | 271/162 |
| 4,429,865 | 2/1984 | Okada | 271/170 |

*Primary Examiner*—Bruce H. Stoner, Jr.
*Assistant Examiner*—Matthew C. Graham
*Attorney, Agent, or Firm*—Watson, Cole, Grindle & Watson

[57] ABSTRACT

A paper feed device includes a paper cassette with separating pawls which can be detachably mounted on the paper feed section of an apparatus body. The separating pawls are retractable out of a sheet-separating position in response to detachment of the cassette from the paper feed section, and positionable into a sheet-separating position in response to mounting of the cassette on the paper feed section.

12 Claims, 17 Drawing Figures

PAPER FEED DEVICE HAVING RETRACTABLE SEPARATING PAWLS

BACKGROUND OF THE INVENTION

1. Field of the Invention

The present invention relates to a paper feed device, and more particularly to a paper feeder for use in electrophotographic copying machines, printers, or the like.

2. Description of the Prior Art

Prior paper feed devices of the type described include a paper cassette containing a stack of copying sheets and can be detachably mounted in a paper feed section of a copying machine body, the arrangement being such that uppermost sheets are fed one by one from the paper cassette loaded in the paper feed section. The known paper feeder includes sheet-separating pawls disposed on both sides at a front end thereof for reliably separating sheets irrespective of the various types of paper used, such as plain paper, film, paper with its surface treated in a special way, and the like, to thereby prevent plural sheets from being fed simultaneously into the copying machine, e.g. as disclosed in U.S. Pat. No. 3,689,064 (Kuksa) and U.S. Pat. No. 4,303,235 (Calabrese).

The sheet-separating pawls project over the stack of sheets and hence will interfere with the sheet stack as it is loaded or replaced. As a solution to this problem, U.S. Pat. No. 4,429,865 (Okada) shows a paper feeder having sheet-separating pawls turnably supported and outwardly displaceable, upon being angularly lifted, out of interference with sheets when they are loaded or replaced. However, the disclosed paper feeder has been disadvantageous in that the sheet-separating pawls have to be turned each time the sheets are loaded or replaced.

SUMMARY OF THE INVENTION

It is a major object of the present invention to provide a paper feed device capable of loading or replacing a stack of sheets in a simple operation without having to retract sheet-separating pawls out of a sheet-separating position.

Another object of the present invention is to provide a paper feed device which includes a paper cassette containing a stack of sheets and which can be detachably mounted on an apparatus body, wherein the sheet-separating pawls are retractable out of a sheet-separating position in response to detachment of the paper cassette from the apparatus body.

Still another object of the present invention is to provide a paper feed device which includes a paper cassette containing a stack of sheets and which can be detachably mounted on an apparatus body, wherein the sheet-separating pawls are positionable into a sheet-separating position in response to the mounting of the paper cassette on the apparatus body.

According to the present invention, there is provided a paper feed device including a paper cassette containing a number of stacked sheets and sheet-separating pawls for separating the sheets one by one from the uppermost sheet layer, the paper cassette being detachably mountable in a paper feed section of a copying machine body or the like, wherein the sheet-separating pawls are operable in response to attachment and detachment of the paper cassette, such that when the paper cassette is mounted in the paper feed section, the separating pawls are positioned in a paper-separating position covering the leading ends of the sheets located therein, and when the paper cassette is detached from the paper feed section the separating pawls are positioned in a retracted position away from the leading ends of the sheets.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
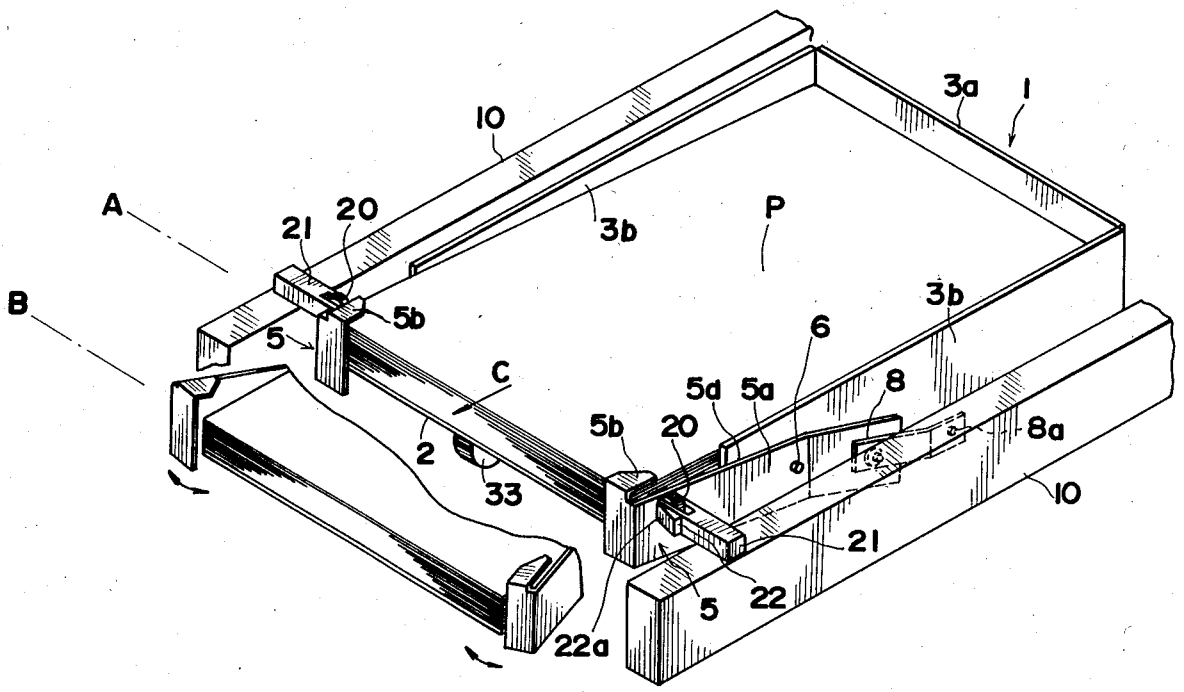
FIG. 1 is a perspective view of a paper feed device according to a first embodiment of the present invention.
Figure 2:
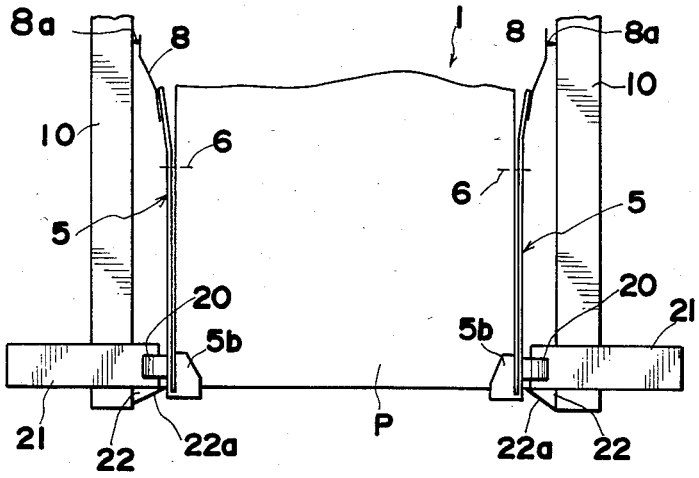
FIG. 2 is a fragmentary plan view of the paper feed device shown in FIG. 1.
Figure 3:
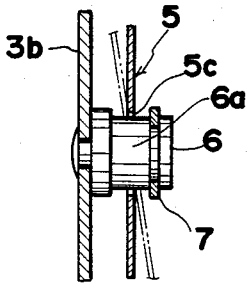
FIG. 3 is an enlarged cross-sectional view of a portion of the paper feed device in which a sheet-separating pawl is supported.

FIGS. 1, 2 and 3 show a paper feed device according to a first embodiment of the present invention. A paper cassette 1 includes a paper support plate 2 which is disposed as a tray bottom and is vertically pivotally movable about a pivot on an end plate 3*a*. The paper cassette 1 can be detached from and mounted in a paper feed section of a copying machine through a suitable guide means such as guide rails 10. When the paper cassette 1 is pushed in the position A shown in FIG. 1, sheets can be fed out of the paper cassette 1, and when the paper cassette 1 is pulled to the position B, sheets can be supplied into the paper cassette 1. Each of the guide rails 10 is of a known construction comprising an outer rail and an inner rail. The outer rail is fixed to the paper feed section, and the paper cassette 1 is attached to the inner rail, which is slidable with respect to the outer rail.

Each of the sheet-separating pawls 5 comprises a base portion 5*a* in the form of a resilient metal plate and a pawl end 5*b* bent from the base portion 5*a*. The separating pawls 5 are supported on side plates 3*b*, 3*b* by pins 6 have ends staked on the side plates 3*b*, 3*b*. The separating pawl 5 with a hole 5*c* fitted loosely over a shank 6*a* of the pin 6 is prevented by an E-ring 7 from being dismounted from the pin 6. The separating pawl 5 is angularly movable about the pin 6 in a vertical plane, and is also horizontally angularly movable due to the backlash present between the hole 5*c* and the shank 6*a* and its own resiliency.

A leaf spring 8 is fixed to an end of the separating pawl 5 and is urged inwardly by a projection 8*a* thereof held against an inner surface of the inner rail of the rail 10. The separating pawl 5 is urged by reaction to move laterally about the pin 6.

Positioning rollers 20 are mounted for rotation in vertical planes on brackets 21 secured to the paper feed section of the copying machine. When the paper cassette 1 is mounted in the paper feed section, the rollers 20 push the separating pawls 5 inwardly in engagement with portions thereof adjacent to the pawl ends 5*b* to cause the pawl ends 5*b* to cover both sides of leading ends of the sheets P stacked on the support plate 2.

In a paper feed position, the stack of sheets P is slightly raised at its leading ends together with the support plate 2 by a pushup roller 33 with an upper surface of the sheet stack held in pressed contact with paper feed rollers (not shown). As the paper feed rollers rotate, the sheets P are fed along one-by-one in the direction of the arrow C from the uppermost sheet. At this time, the sides of the sheets P move forcibly past the pawl ends 5*b* while in abutment thereagainst, so that the sheets P can be reliably separated one by one, rather than being fed in simultaneous multiple sheets, without being affected by the types of paper such as plain paper, film, paper with its surface treated in a special manner, and the like.

As the paper cassette 1 is pulled out of the paper feed section, the separating pawls 5 are released from the positioning rollers 20, and the leaf springs 8 are pivoted laterally about the pins 6 under reactive forces from the rails 10 until the pawl ends 5*b* are retracted from the sides of the leading ends of the sheets P. New sheets can be supplied onto the support plate 2 or onto a few sheets P remaining thereon in the position in which the paper cassette 1 has been pulled out. The sheets being supplied can smoothly be stacked without interference with the pawl ends 5*b*.

For mounting the paper cassette 1 in the paper feed section, the paper cassette 1 is simply pushed into the paper feed section. On the inserting stroke of the paper cassette 1, the positioning rollers 20 are first brought into engagement with slanted upper edges 5*d* and then ride onto the separating pawls 5 to urge the pawl ends 5*b* inwardly. The brackets 21 have guide members 22 with slanted surfaces 22*a* for guiding the positioning rollers 20 smoothly.

The positioning rollers 20 are rotatable in vertical planes to guide the separating pawls 5 to turn vertically together with the support plate 2 in response to vertical movement of the pushup roller 33.

FIGS. 4 through 8 illustrate paper feed devices respectively according to second through sixth embodiments of the present invention. According to the second embodiment shown in FIG. 4, the leaf spring 8 of the first embodiment is attached to the rear end of the separating pawl 5 in an opposite direction with the projection 8*a* located in coaxial relation to the pin 6. Upon abutment of the projection 8*a* against the inner rail of the guide rail 10, the rear end of the separating pawl 5 is pushed inwardly, and the pawl end 5*b* is urged laterally about the pin 6.

Figure 5:
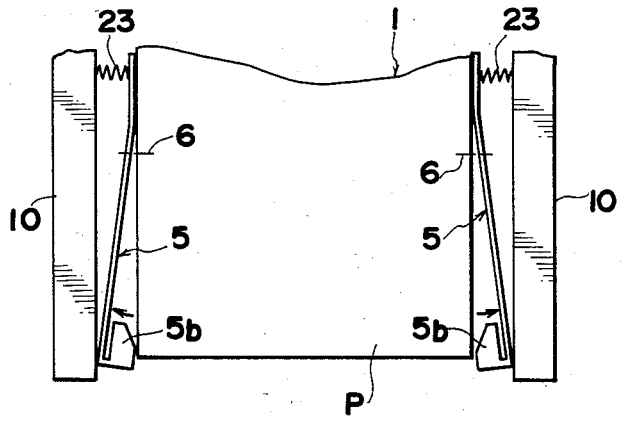
FIG. 5 is a plan view of sheet-separating pawls in a paper feed device according to a third embodiment, the view also showing adjacent parts.
Figure 6:
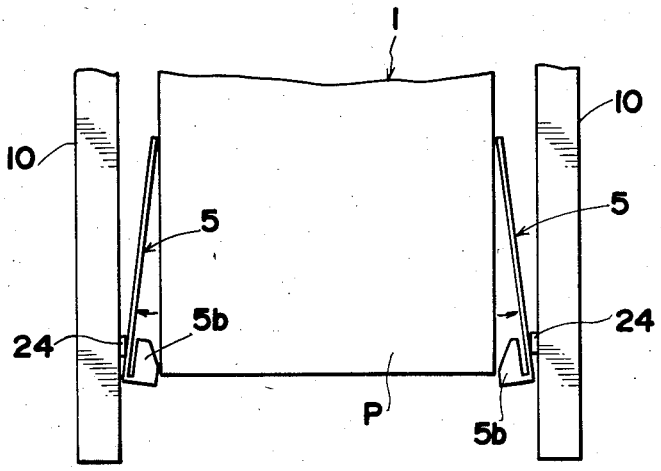
FIG. 6 is a plan view of sheet-separating pawls in a paper feed device according to a fourth embodiment, the view also showing adjacent parts.

According to the third embodiment shown in FIG. 5, the separating pawls 5 are angularly movable horizontally and vertically about the pins 6, and coil springs 23 are disposed under compression between the rear ends of the separating pawls 5 and the inner rails of the guide rails 10 for normally urging the separating pawls 5 to spread outwardly. In the fourth embodiment of FIG. 6, permanent magnets 24 are attached to the inner rails of the guide rails 10, and the separating pawls 5, which are mounted for angular movement in horizontal and vertical planes about the pins 6 are made of magnetic material. The pawl ends 5*b* of the separating pawls 5 are urged to move laterally under magnetic forces from the permanent magnets 24.

In each of the second, third and fourth embodiments, the separating pawls are angularly movable horizontally for retracting movement away from the paper-separating position, as with the first embodiment. In the paper feed position, the distal ends of the separating pawls 5 are pushed inwardly by non-illustrated positioning rollers (indicated by 20 in FIGS. 1 and 2) to position the pawl ends 5*b* in the paper-separating position. When the paper cassette 1 is pulled out of the paper feed section, the separating pawls 5 are released from the positioning rollers 20 to allow the pawl ends 5*b* to be retracted laterally.

Figure 4:
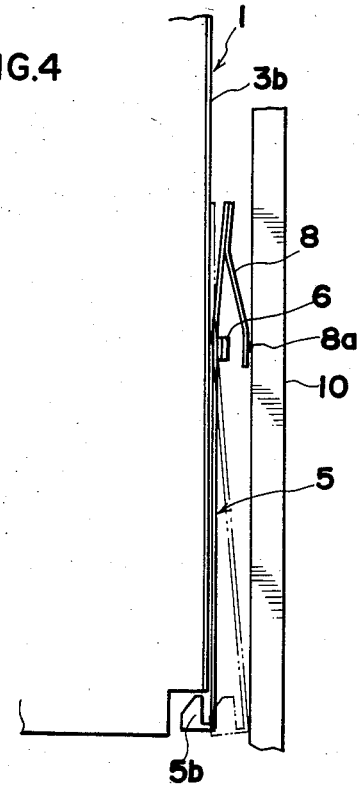
FIG. 4 is a plan view of a sheet-separating pawl in a paper feed device according to a second embodiment, the view also showing adjacent parts.

The separating pawls 5 can be angularly moved quite smoothly by positioning the projection 8*a* in coaxial relation to the pin 6 as shown in FIG. 4.

Figure 7:
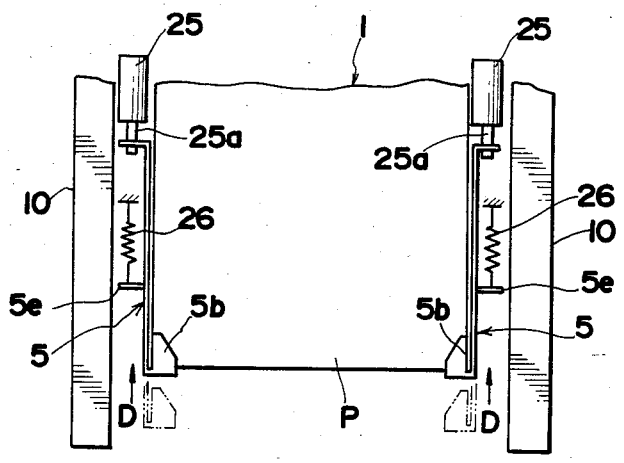
FIG. 7 is a plan view of sheet-separating pawls in a paper feed device according to a fifth embodiment, the view also showing adjacent parts.

FIG. 7 shows a fifth embodiment in which the separating pawls 5 are retracted in a direction in which the paper cassette 1 is pulled out. The separating pawls 5 have oblong holes in which pins projecting from the paper cassette 1 are loosely fitted, so that the separating pawls 5 are movable in the direction of the arrow D and a direction opposite thereto. To the rear ends of the separating pawls 5, there are coupled plungers 25*a* of solenoids 25. The separating pawls 5 have ledges 5*e* cut out thereof with return springs 26 secured thereto. The solenoids 25 are electrically connected to a means (not shown) for detecting whether the paper cassette 1 is mounted in the paper feed section or not. When the paper cassette 1 is mounted in the paper feed section, the solenoids 25 are de-energized, and when the paper cassette 1 is pulled out of the paper feed section, the solenoids 25 are energized. Therefore, when the paper cassette 1 is in the paper feed position, the solenoids 25 are de-energized to allow the separating pawls 5 to be biased in the direction of the arrow D by the return springs 26 with the pawl ends 5*b* positioned in the paper-separating position. As the paper cassette 1 pulled out, the solenoids 25 are turned on to move the separating pawls 5 in the direction opposite to the direction of the arrow D. As indicated by the dotted lines in FIG. 7, the pawl ends 5b are retracted from the paper-separating position.

Figure 8:
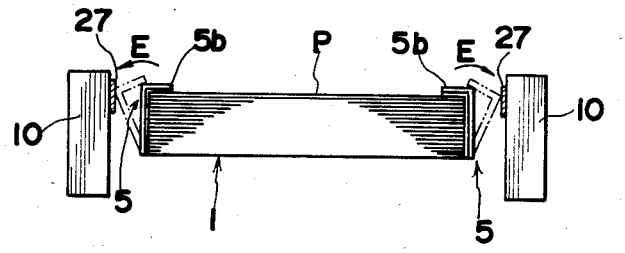
FIG. 8 is a front elevational view of sheet-separating pawls in a paper feed device according to a sixth embodiment, the view also showing adjacent parts.

FIG. 8 shows a sixth embodiment in which the separating pawls 5 of magnetic material are mounted for angular movement in the direction of the arrow E and a direction opposite thereto, and permanent magnets 27 are attached to the inner rails of the guide rails 10. The pawl ends 5b are urged to move in the direction of the arrow E away from the paper-separating position under magnetic forces from the permanent magnets 27.

The paper feed section will be described in detail with reference to FIG. 9 and following.

As illustrated in FIGS. 9 through 12, the paper cassette 1 is mounted on the inner rails 10a of the rails 10, with the outer rails 10b thereof fixed to the frame of a copying machine body. The paper cassette 1 is movable in the direction of the arrow F and a direction opposite thereto. The paper feed section includes a paper pushup lever 31 disposed directly below the paper cassette 1 and supported angularly movably by a support shaft 30 in a direction normal to the direction in which the paper cassette 1 is movable. The paper pushup lever 31 has a central lever member 32a on which the pushup roller 33 is rotatably mounted, lever members 32b, 32b at opposite end portions thereof with pushdown rollers 34, 34 rotatably mounted thereon, and lock rollers 35, 35 rotatably mounted on opposite ends of the paper pushup lever 31. The paper pushup lever 31 is normally urged to move in the direction of the arrow G by coil springs 36, 36 having ends attached to the lever members 32b, 32b.

Lock levers 37, 37 are angularly movably mounted by support shafts 38 on opposite sides of the paper feed section, and are normally urged to move in the direction of the arrow H by return springs 39, 39. The paper pushup lever 31 is prevented from being moving upwardly upon engagement of the lock rollers 35 in recesses 37a in the lock levers 37. Guide plates 40, 40 are each composed of a slanted portion 40a and a horizontal portion 40b, and attached to the inner rails 10a so as to project laterally beyond the rails 10, the guide plates 40, 40 being movable with the paper cassette 1. As the paper cassette 1 is pulled out, the guide plates 40 push down the pushdown rollers 34 to turn the paper pushup lever 31 in the direction opposite to the direction of the arrow G. Trigger levers 41, 41 are secured to distal ends of the inner rails 10a, 10a, respectively. When the trigger levers 41 are pushed in together with the paper cassette 1, the trigger levers 41 turn the lock levers 37 in the direction opposite to the direction of the arrow H, thus releasing the recesses 37a out of engagement with the lock rollers 35.

Figure 11:
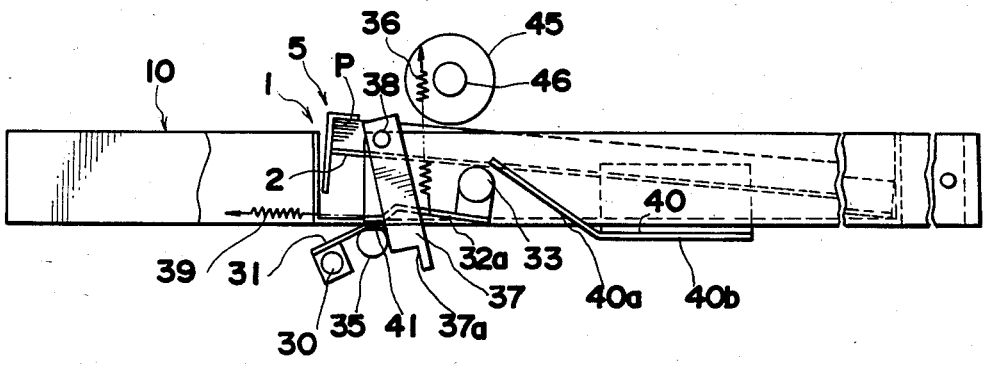
FIG. 11 is a side elevational view showing the paper cassette mounted in the apparatus body.

Operation of the foregoing construction is as follows: When the paper cassette 1 is mounted in the paper feed section, that is, when the paper cassette 1 is pushed into the paper feed section as shown in FIGS. 9 and 11, the trigger levers 41 depress the lock levers 37 to turn the lock levers 37 slightly in the direction opposite to the direction of the arrow H, releasing the recesses 37a out of engagement with the lock rollers 35. At this time, the paper pushup levers 31 is turned in the direction of the arrow G about the support shafts 30 to cause the pushup rollers 33 to lift the distal end of the sheet support plate 2. The sheets P are lifted with the support plate 2 until the uppermost sheet layer is pressed against the paper feed rollers 45. At the same time that the paper cassette 1 is mounted in the paper feed section, the separating pawls 5, 5 are turned inwardly to cause the pawl ends 5b to cover the corners at the leading ends of the sheets in the manner described above.

The uppermost one of the sheets P is separated by the separating pawls 5 and fed along in the direction of the arrow C in response to rotation of the paper feed rollers 45, 45 in the direction of the arrow I. There are one-way clutches (not shown) interposed between the paper feed rollers 45, 45 and a support shaft 46 mounting them thereon for transmitting rotative power only in the direction of the arrow I from the support shaft 46 to the paper feed rollers 45, 45. Upon paper feeding, the paper feed rollers 45, 45 are driven in one rotation and the sheet fed out of the paper cassette 1 is immediately transferred forcibly by transfer rollers (not shown).

As the remaining sheets P become fewer in repeated paper feeding cycles, the paper pushup lever 31 is turned in the direction of the arrow G under the bias of the coil springs 36, 36, thereby raising the pushup roller 33 to lift the support plate 2 for forcing the sheet stack to be pressed against the paper feed rollers 45 under a constant force.

Figure 12A:
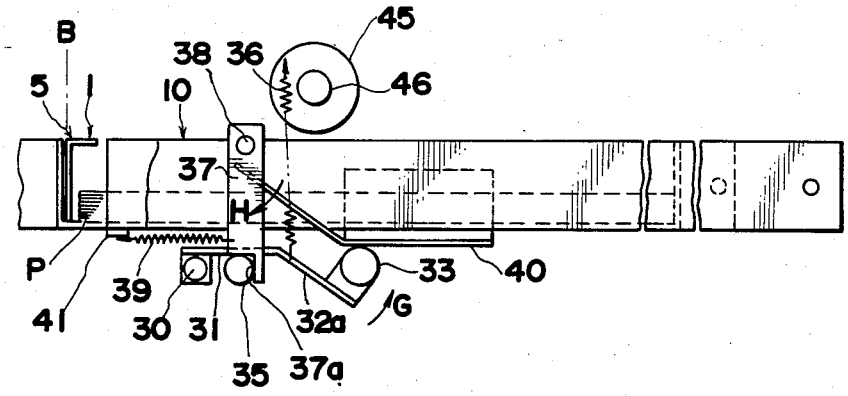
FIGS. 12*a* and 12*b* are side elevational views illustrative of the paper cassette pulled out of the apparatus body.
Figure 12B:
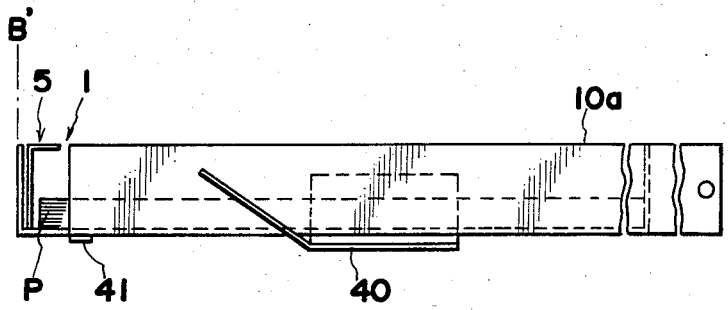

Sheets can be supplied while the paper cassette 1 is being pulled out. As shown in FIG. 12b, in response to pulling the paper cassette 1 leftward in FIG. 12a, the trigger levers 41 are released out of abutment against the lock levers 37, which are then angularly moved in the direction of the arrow H under the resilient force of the return springs 39. The pushdown rollers 34 are depressed by the slanted portions 40a and then the horizontal portions 40b of the guide plates 40 to turn the paper pushup lever 31 in the direction opposite to the direction of the arrow G. The pushup roller 33 is now lowered to allow the support plate 2 to turn to the horizontal position. Simultaneously, the lock rollers 35 engage into the recesses 37a in the lock levers 37 to lock the paper pushup lever 31. At this time, the separating pawls 5 are retracted from the leading ends of the sheets so that new sheets can easily be supplied into the paper cassette 1.

Figure 9:
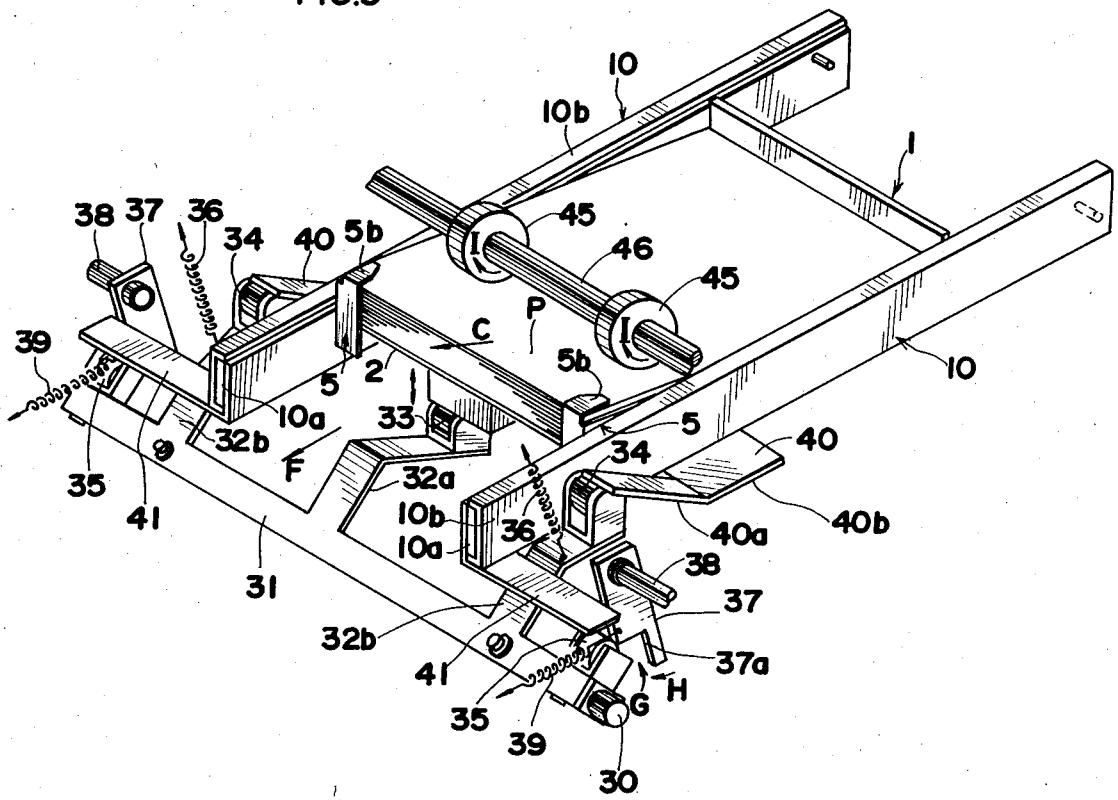
FIG. 9 is a perspective view of a paper feed device of the invention, composed of an apparatus body and a paper cassette detachably mounted therein.
Figure 10:
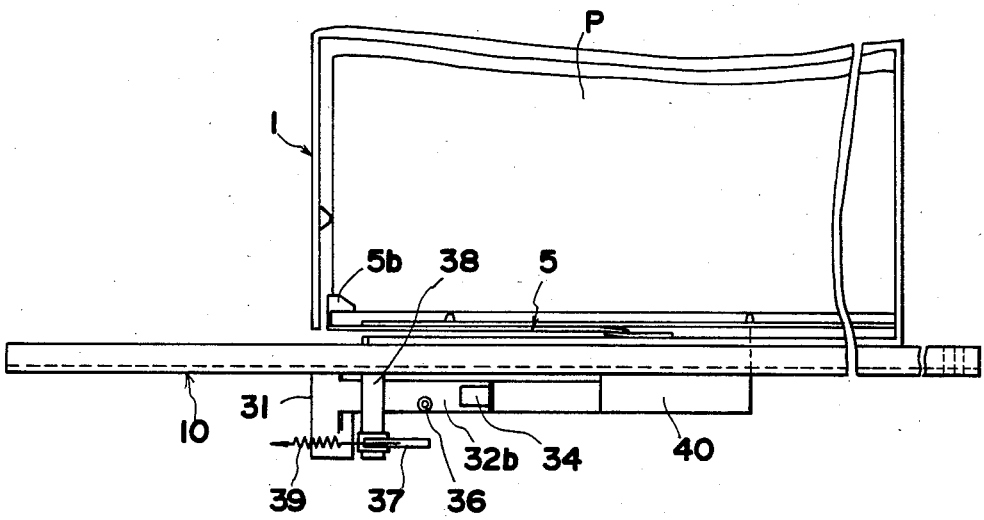
FIG. 10 is a plan view of the paper feed device illustrated in FIG. 9.

By pushing the paper cassette 1 into the paper feed section again, the paper pushup levers 31 and other parts return to the position shown in FIGS. 9 and 11 to permit sheets to be fed out of the paper cassette 1. The paper cassette 1 can be pulled to the left from the position B in FIG. 12a to the position B' in FIG. 12b, in which the inner rails 10a can be detached from the outer rails 10b by lifting the closer end of the paper cassette 1, so that the paper cassette 1 itself can be removed from the paper feed section.

Figure 13:
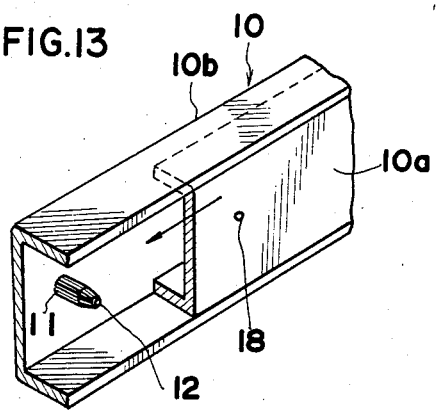
FIG. 13 is a perspective view of a mechanism for positioning the paper cassette with respect to the apparatus body.
Figure 14:
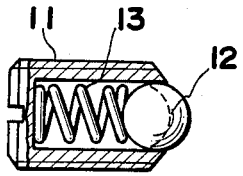
FIG. 14 is cross-sectional view of a spring plunger.

Upon paper feeding, since rotative power from the paper feed rollers 45, 45 is transmitted from the sheets P to the paper cassette 1, the paper cassette 1 should be positioned accurately in the paper feed position. To achieve such accurate positioning of the paper cassette 1, a spring plunger 11 composed of a steel ball 12 urged by a coil spring as shown in FIGS. 13 and 14 is mounted on the outer rail 10b, and the inner rail 10a has a hole 18 defined therein in which the steel ball 12 can be fitted. When the paper cassette 1 reaches the paper feed position, the steel ball 12 fits in the hole 18 to position the paper cassette 1.

Figure 15:
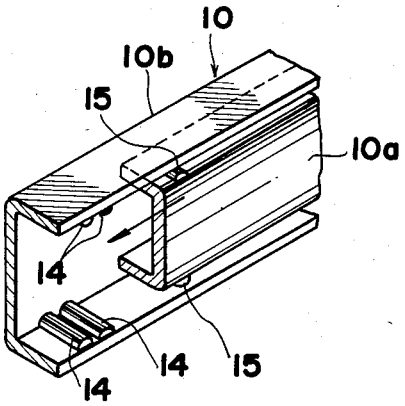
FIGS. 15 and 16 are perspective views of modified mechanisms for positioning the paper cassette with respect to the apparatus body.

FIG. 15 shows another modification in which ridges 14, 14 are formed on opposite surfaces of the outer rail 10b, and projections 15 are formed on upper and lower surfaces of the inner rail 10a. When the paper cassette 1 arrives at the paper feed position, the projections 15 are fitted between the ridges 14, 14 to position the paper cassette 1.

Figure 16:
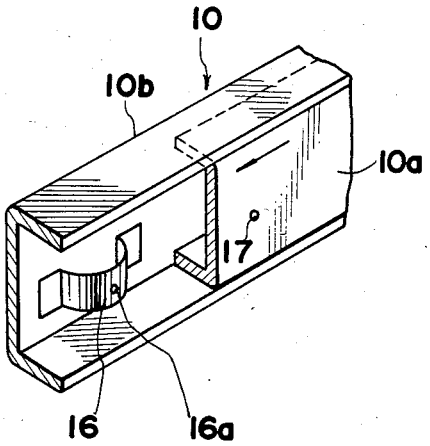

FIG. 16 illustrates still another modification in which an arcuate leaf spring 16 having a central projection 16*a* is mounted on an inner side surface of the outer rail 10*b*, and the inner rail 10*a* has a hole 17 in which the projection 16*a* can fit. The paper cassette 1 can be positioned by the projection 16*a* fitted in the hole 17 in the manner described above with reference to FIG. 13.

With the construction of the paper feed section described with reference to FIG. 9 and following, the paper cassette 1 attached to the inner rails 10*a* can be mounted in the paper feed section in one operation to push in the paper cassette 1 and can be detached from the paper feed section in one operation to pull the paper cassette 1. Sheets can be supplied into the paper cassette while the latter is being pulled out. The paper supply process of the invention is much simpler than conventional processes in which sheets have to be supplied with the paper cassette 1 detached from the paper feed section and the paper cassette 1 can only be detached from the paper feed section by unlocking the paper cassette 1.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A paper feed device which is cooperable with a paper feed section of an apparatus body, said paper feed device comprising:

a cassette member containing sheets, said cassette member being detachably mountable on the paper feed section of an apparatus body;

separating pawls made of magnetic members movably supported on both sides of said cassette member between an actuating position where said separating pawls rest on both sides of leading ends of the sheets located in said cassette member and a non-actuating position where said separating pawls are retracted laterally away from the sides of the leading ends of the sheets;

magnetic means for attracting said separating pawls into said non-actuating position when said cassette member is detached from the paper feed section of the apparatus body; and positioning means actuable by the mounting of said cassette member on the paper feed section of the apparatus body for moving said separating pawls into said actuating position.

2. A paper feed device which is cooperable with a paper feed section of an apparatus body, said paper feed device comprising:

a cassette member for containing sheets, said cassette member being detachably mountable on the paper feed section of an apparatus body;

separating pawls movably supported on both sides of the cassette member between an actuating position where said separating pawls rest on both sides of leading ends of the sheets and a non-actuating position where said separating pawls are retracted laterally from the sides of the leading ends of the sheets located in said cassette member, said separating pawls being supported vertically turnably relative to the sheet surface;

urging means for urging the separating pawls in a direction from said actuating position to said non-actuating position when said cassette member is detached from the paper feed section of the apparatus body; and positioning rollers actuable by the mounting of said cassette member on the paper feed section for rotation in a vertical plane relative to sheet surface, said positioning rollers pushing said separating pawls to said actuating position when said cassette member is mounted on the paper feed section of the apparatus body and guiding said separating pawls to turn vertically relative to the sheet surface.

3. A paper feed device as claimed in claim 2, wherein said separating pawls are supported loosely by pivot means secured to opposite sides of said cassette member, and said separating pawls are angularly movable about said pivot means in a vertical plane and a horizontal plane concerning the sheet surface.

4. A paper feed device as claimed in claim 3, wherein said urging means comprises spring members contacting said separating pawls.

5. A paper feed device as claimed in claim 4, wherein each said spring member is a leaf spring, one end of which is secured to a said separating pawl, and another end of which has a projection pressed elastically on the cassette member.

6. A paper feed device as claimed in claim 5, wherein said projection is located in coaxial relation to said pivot means.

7. A paper feed device as claimed in claim 4, wherein each said spring member is a coil spring, one end of which is secured to a said separating pawl, and another end of which is pressed elastically on said cassette member.

8. A paper feed device as claimed in claim 3, wherein said separating pawls are made of magnetic metal, and said urging means comprises magnet members which attract said separating pawls.

9. A paper feed device as claimed in claim 2, further comprising means for guiding said cassette member when being mounted on and removed from the paper feed section.

10. A paper feed device as claimed in claim 9, wherein said guiding means comprises inner rails which are slidable in outer rails which are secured to the paper feed section of the apparatus body.

11. A paper feed device as claimed in claim 10, further comprising a cassette positioning means for positioning said cassette member to the paper feed section of the apparatus body.

12. A paper feed device as claimed in claim 11, wherein said cassette positioning means comprises a projection member secured to one of said two rails, and a dent portion formed in another of them fitting with said projection.

* * * * *